United States Patent [19]

Midura

[11] Patent Number: 4,562,922

[45] Date of Patent: Jan. 7, 1986

[54] SEAL END DISPLAY CARTON

[75] Inventor: Kenneth J. Midura, Chicopee, Mass.

[73] Assignee: Champion International Corporation, Stamford, Conn.

[21] Appl. No.: 619,217

[22] Filed: Jun. 11, 1984

[51] Int. Cl.[4] ..... B65D 5/50

[52] U.S. Cl. ..... 206/45.19; 229/16 D; 229/34 HW

[58] Field of Search ..... 206/45.14, 45.19, 44 R, 206/45.13, 45.16, 45.17, 45.2; 229/16 D, 34 HW

[56] References Cited

U.S. PATENT DOCUMENTS

| | | | |
|---|---|---|---|
| 2,313,718 | 3/1943 | Berg | 206/45.19 |
| 2,318,452 | 5/1943 | Berg | 206/45.14 |
| 2,464,951 | 3/1949 | Stengren | 206/45.19 |
| 2,870,951 | 1/1959 | Struble | 229/34 HW |
| 2,937,743 | 5/1960 | Bultery et al. | 206/45.14 |
| 3,608,705 | 9/1971 | Moshel | 206/45.19 X |
| 3,622,064 | 11/1971 | Carter et al. | 229/34 HW |
| 3,989,139 | 11/1976 | Vargo | 229/34 HW |
| 4,037,717 | 7/1977 | Roccaforte | 206/45.14 |
| 4,159,765 | 7/1979 | Roccaforte | 206/45.19 |

*Primary Examiner*—Allan N. Shoap
*Assistant Examiner*—Bryon Gehman
*Attorney, Agent, or Firm*—Evelyn M. Sommer; William W. Jones

[57] ABSTRACT

A display carton is formed from a one-piece paperboard blank which can be prefolded and glued into a partially erected flat bulk shipping configuration. The carton has a hinged platform on which the article to be displayed is placed. Opposite ends of the displayed article are captured by closed end portions of the platform. A two-ply header card forms the back portion of the carton.

2 Claims, 9 Drawing Figures

SEAL END DISPLAY CARTON

This invention relates to a carton formed from a cut and scored one-piece paperboard blank, which carton is used to package and display an article of merchandise.

Cartons which are operable to package and at the same time display articles of merchandise are generally known. Examples of such cartons are shown in U.S. Pat. Nos. 2,313,718 to E.C. Berg; 2,464,951 to J. Stengren; 2,781,898 to J. D. Desmond et al; 3,057,466 to H. Blonder et al; 3,874,500 to T. H. Nicholl; and 4,159,765 to H. I. Roccaforte.

One important feature which is desirable in such display cartons is the ability to partially erect the carton to a partially glued and folded flattened configuration which is suitable for bulk shipment from the carton manufacturer to the packager. It is also important to be able to form such cartons from a one-piece cut, scored paperboard blank.

The carton of this invention is formed from a one-piece cut and scored paperboard blank which can be folded and glued to a flattened bulk shipping configuration. The flattened configuration can be readily expanded to an operative configuration which receives the article to be packaged and displayed. The carton includes a platform for supporting the article to be displayed, which platform is hinged to the front and back of the carton. End straps are disposed at either end of the platform with the end straps being formed as extensions of the front wall of the carton and hinged to the back wall. Side closure flaps are foldably connected to the back panel, the bottom panel and the end straps so as to close off the side portions of the carton which receive the respective end portions of the packaged articles. The back of the carton is a two-ply header card which extends above the end straps and is used to display article graphics.

It is, therefore, an object of this invention to provide an article display carton which is formed from a one-piece cut and scored paperboard blank and which can be folded and glued to form a partially erected flattened bulk shipping configuration.

It is a further object of this invention to provide a carton of the character described which includes a platform for supporting the article to be displayed which platform is hinged to the front and back walls of the carton.

It is an additional object of this invention to provide a carton of the character described which includes article-encompassing straps at either end of the platform for confining opposite end portions of the article being displayed.

It is another object of this invention to provide a carton of the character described which includes closure flaps for closing off outer ends of the straps to retain the article on the platform and within the confines of the straps.

It is yet a further object of this invention to provide a carton of the character described which includes a two-panel header card back portion providing a graphics display area above the article being displayed.

These and other objects and advantages of this invention will become more readily apparent from the following detailed description of preferred embodiments of blanks and cartons formed in accordance therewith when taken in conjunction with the accompanying drawings in which.

Figure 1:
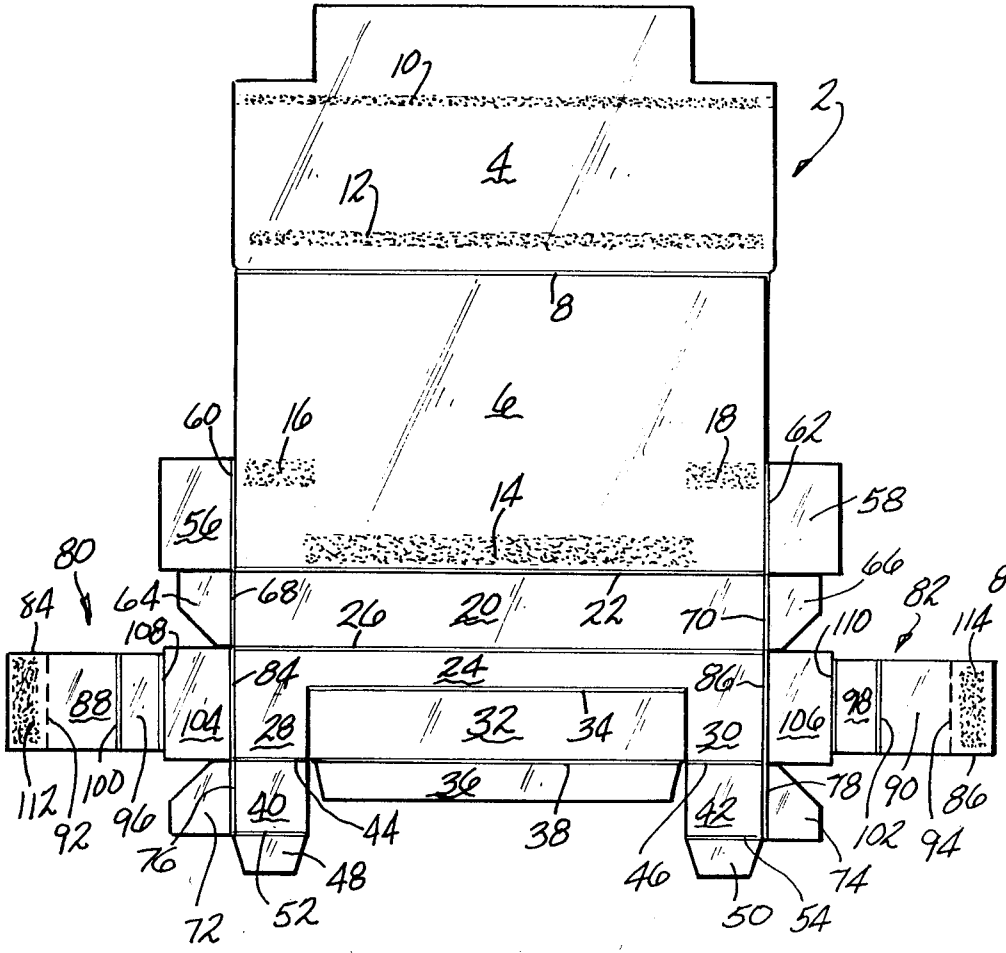
FIG. 1 is a plan view of a preferred embodiment of a cut and scored paperboard blank from which the carton of this invention can be formed.

Referring now to the drawings, FIG. 1 illustrates in plan view a cut and scored paperboard blank denoted generally by the numeral 2 which may be folded and glued to form the carton of this invention. The blank 2 includes a first header card panel 4 which is foldably connected to a second header card panel 6 along a fold line 8. A pair of adhesive strips 10 and 12 are disposed on the first header card panel 4, and an adhesive strip 14 is disposed on panel 36. Additionally, a pair of adhesive spots 16 and 18 are disposed on panels 48 and 50, respectively. A bottom wall panel 20 is foldably connected to the second header card panel 6 along a fold line 22. A front wall panel 24 is foldably connected to the bottom wall panel 20 along a fold line 26 and a pair of front end straps 28 and 30 project from opposite end portions of the front wall panel 24. A platform panel 32 is foldably connected to the front wall panel 24 along a fold line 34 and a glue flap 36 is foldably connected to the platform panel along a fold line 38. A pair of top end straps 40 and 42 are foldably connected to the front end straps 28 and 30 along fold lines 44 and 46 respectively. Glue flaps 48 and 50 are foldably connected to the top end straps 40 and 42 along fold lines 52 and 54 respectively. Side closure panels 56 and 58 are foldably connected to the second header card panel 6 along fold lines 60 and 62 respectively. Additional side closure panels 64 and 66 are foldably connected to the bottom wall panel 20 along fold lines 68 and 70 respectively, and side closure panels 72 and 74 are foldably connected to the top end straps 40 and 42 along fold lines 76 and 78 respectively. Compound side closure panels 80 and 82 are foldably connected to the front end straps 28 and 30 along fold lines 84 and 86 respectively. The compound side closure panels 80 and 82 include glue tabs 84 and 86 which are connected to inner partition panels 88 and 90 along fold lines 92 and 94 respectively. Connecting panels 96 and 98 are connected, on one hand, to the inner partition panels 88 and 90 along fold lines 100 and 102 respectively, and, on the other hand, to outer partition panels 104 and 106 along fold lines 108 and 110 respectively. Adhesive 112 and 114 is deposited on the glue tabs 84 and 86.

Figure 2:
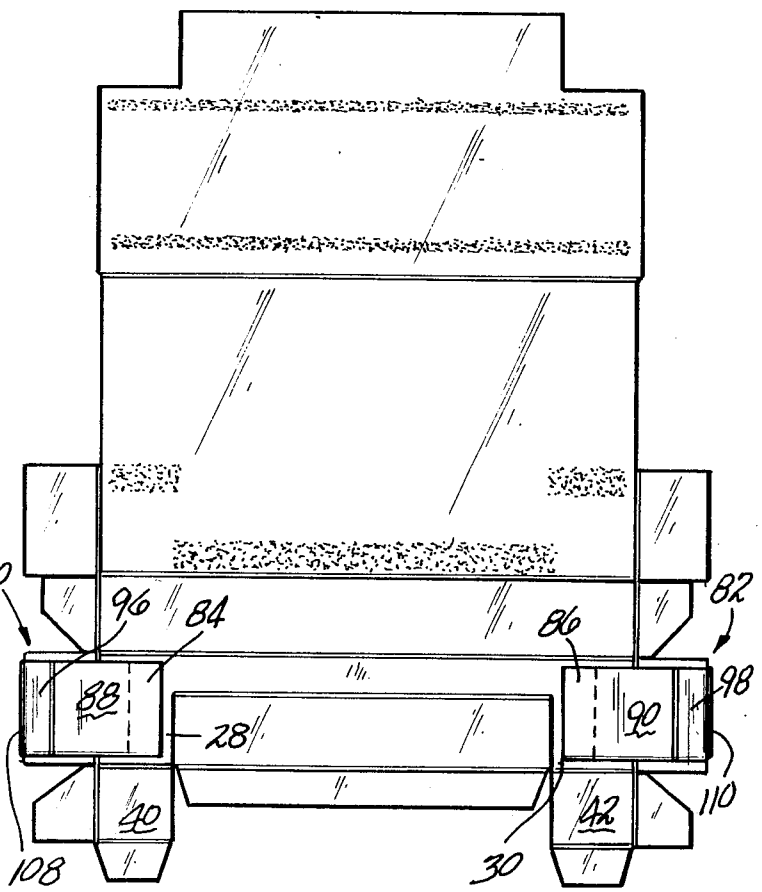
FIG. 2 is a plan view of the blank of FIG. 1 showing the first folding step utilized to create the flattened bulk shipping configuration of the carton.
Figure 3:
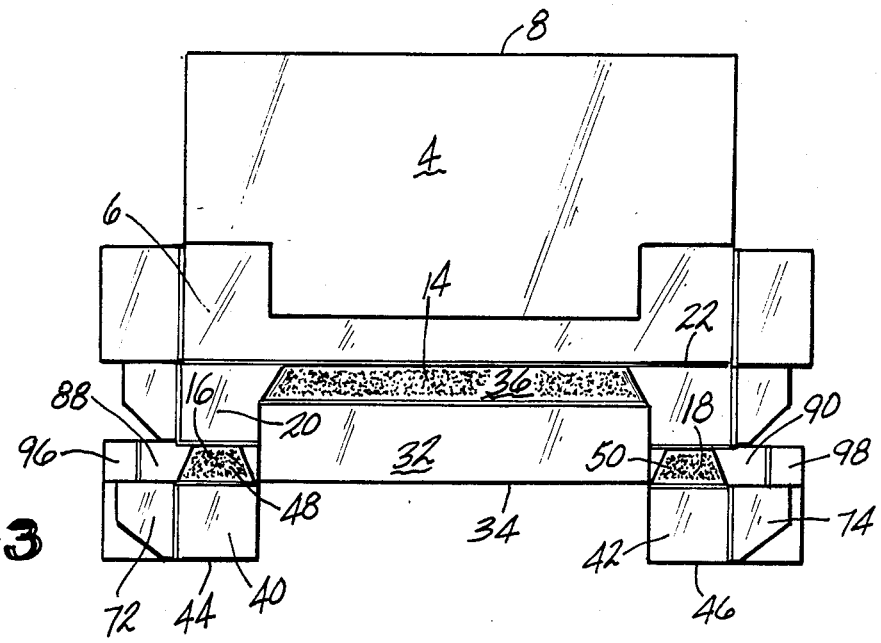
FIG. 3 is a plan view of the blank of FIGS. 1 and 2 show the second folding step utilized to create the flattened bulk shipping configuration of the carton.
Figure 4:
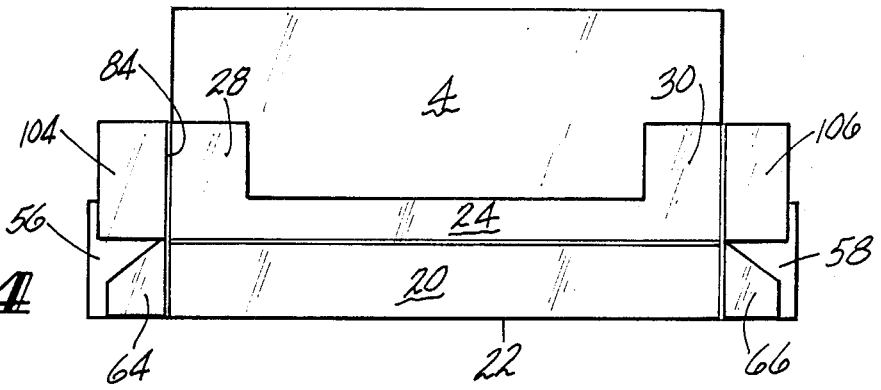
FIG. 4 is a plan view of the blank of FIGS. 1–3 showing the flattened bulk shipping configuration of the carton created by a final folding step.

Referring now to FIGS. 2–4, the folding sequence for converting the blank 2 to the flattened bulk shipping configuration of the carton is shown. First, the compound side closure panels 80 and 82 are folded toward each other about the fold lines 108 and 110 respectively. This brings the glue tabs 84 and 86 into face-to-face contact with the front end straps 28 and 30 respectively resulting in adherence of the tabs 84 and 86 to the straps 28 and 30. The first header card panel 4 is then folded about the fold line 8 into overlying relationship with the second header card panel 6 whereby the two are adhered together by the adhesive strips 10 and 12. The top end straps 40 and 42 are folded about the fold lines 44 and 46 into overlying relationship with the glue tabs 84 and 86. This brings the side closure panels 72 and 74 into overlying relationship with the panels 88, 96 and 90, 98 respectively. The platform panel 32 is folded about the fold line 34 into overlying relationship with the front wall panel 24 and the bottom wall panel 20. This moves the glue flap 36 adjacent to the adhesive strip 14, as shown in FIG. 3. The final folding operation involves folding the bottom wall panel 20 about the fold line 22 into overlying relationship with the two ply header card panel 4, 6. This folding operation brings the glue flaps 48 and 50 against the adhesive spots 16 and 18 to secure the flaps 48 and 50 to the second header card panel 6. This folding operation also brings the glue flap 36 against the adhesive strip 14 thereby securing the flap 36 to the second header card panel 6. The flattened bulk shipping configuration of the carton depicted in FIG. 4 is thus formed.

Figure 5:
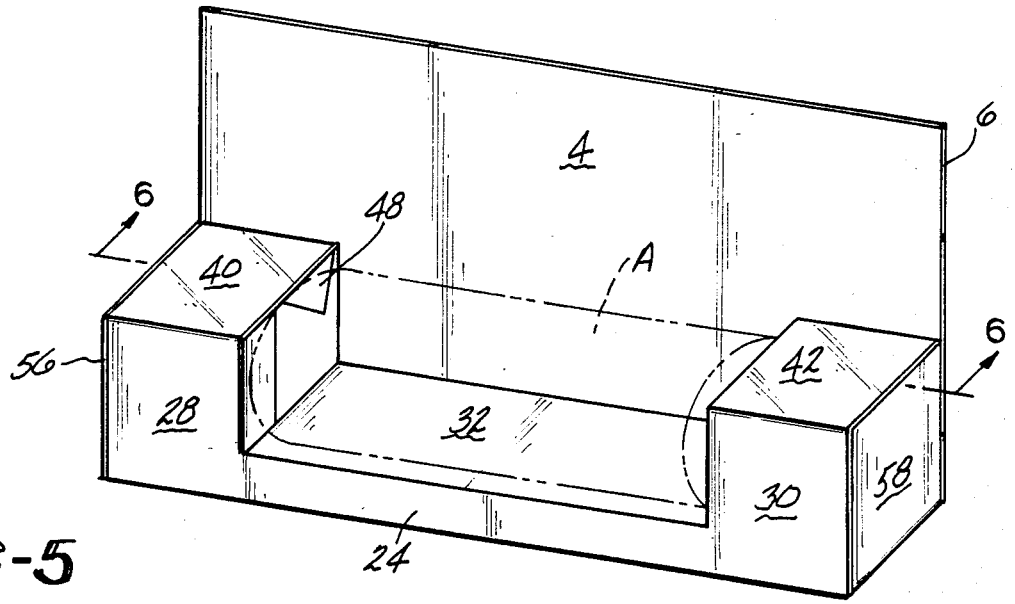
FIG. 5 is a perspective view of the erected carton formed from the blank of FIGS. 1–4 with the displayed article being shown therein in phantom lines.

Referring now to FIG. 5, the erected carton is shown. It will be noted that the panels 4 and 6 combine to form a compound header card on which graphics can be printed on both front and back. The platform panel 32 is hinged to both the front wall panel 24 and the back header card panel 6 and extends therebetween. The front end straps 28 and 30 extend upwardly above the platform panel 32 and the top end straps 40 and 42 are hinged to both the front end straps 28 and 30 and the back header card panel 6 and extend therebetween upwardly spaced apart from the platform panel 32. Thus, the platform panel 32, the straps 28, 30, 40 and 42 and the header card panels 4 and 6 combine to form a tube in which the article A (shown in phantom) can be inserted. The central portion of the tube is open so that the article can be viewed. The ends of the article A are retained by the straps 28, 30, 40 and 42 and the side closure panels 56 and 58 form the outermost surfaces on the side closures of the article-retaining tube. It will be understood that one side closure assembly is closed after the carton is expanded, the article A is then dropped into place through the other open side, and the latter is then closed to complete the package.

Figure 6:
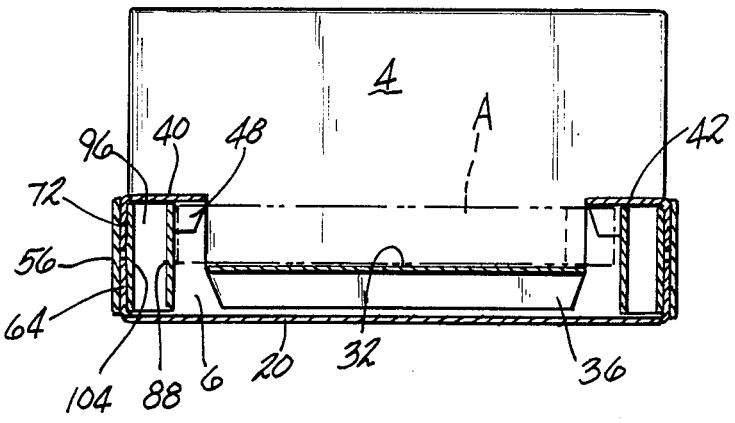
FIG. 6 is a sectional view of the carton taken along line 6—6 of FIG. 5.

Referring now to FIG. 6, details of the side closures are more clearly seen. It will be noted that the side closures adjacent each end of the article A are compound closures which cushion each end of the article A. It will be noted that when the side closures are closed, the outer partition panel 104 is pushed in so that it pivots about fold line 84 (see FIG. 4) until it is perpendicular to the front and back panels 24 and 6. This causes the free connecting panel 96 to slide into the carton in face-to-face contact with the back panel 6, as shown in FIG. 6. At the same time, the inner partition panel 88 pivots into a position parallel to the outer partition panel 104 and spaced apart therefrom by the connecting panel 96. This pivoting is enabled by the fact that the glue flap 84 is adhesively secured to the inside surface of the front end strap 28, as shown in FIG. 2. The side closure panels 64 and 72 are then folded down over the outside surface of the outer partition panel 104, and the side closure panel 56 is folded over the outside of the panels 64 and 72. The closure panels 56, 64 and 72 are secured together in a suitable manner. In this manner, both side closure assemblages which retain the ends of the article A axially within the carton provide cushioning for the ends of the article A.

Figure 7:
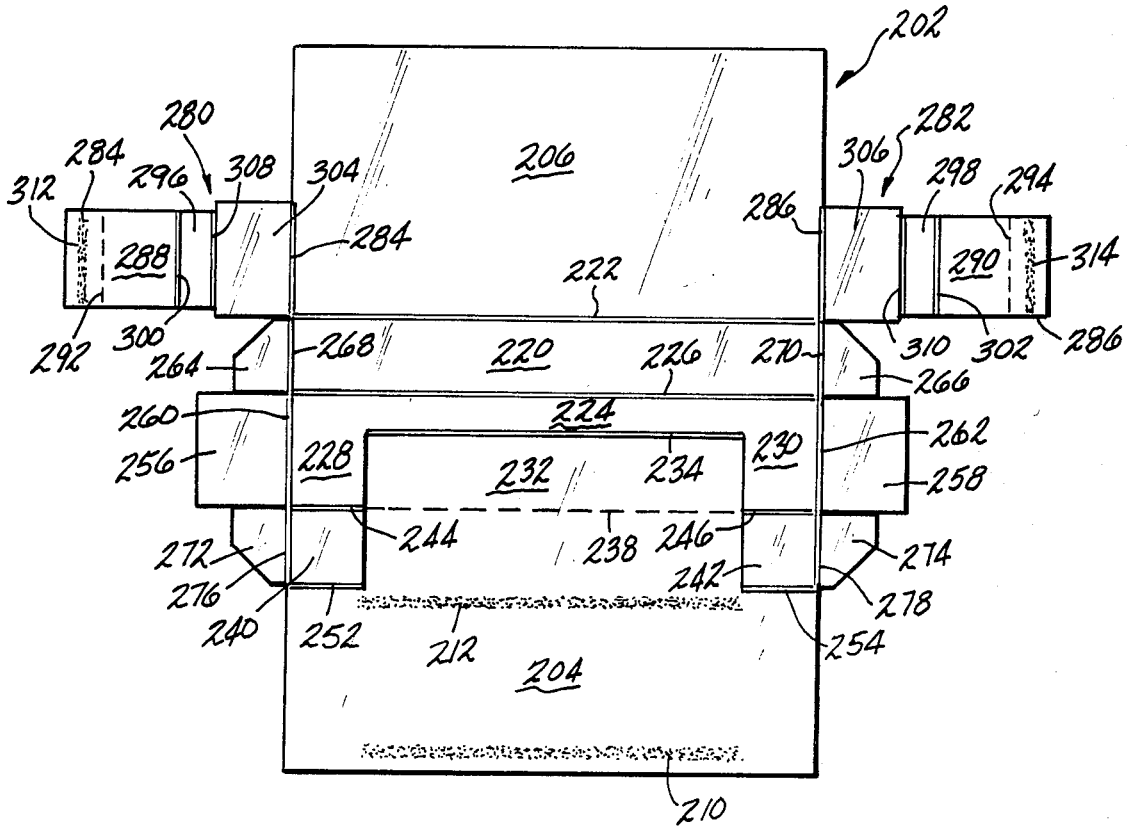
FIG. 7 is a plan view of a second embodiment of a cut and scored paperboard blank adapted for forming the carton of this invention.

Referring now to FIG. 7, there is shown a second embodiment of a cut and scored paperboard blank which is denoted generally by the numeral 202 and which is adapted to form the carton of this invention. The blank 202 includes a first header card panel 206 which is foldably connected to a bottom wall panel 220 along a fold line 222. The bottom wall panel 220 is hinged to a front wall panel 224 along a fold line 226. Front end straps 228 and 230 extend from opposite front end portions of the front wall panel 224. A platform panel 232 is hinged to the front wall panel 224 along a fold line 234. Top end straps 240 and 242 are hinged to front end straps 228 and 230 along fold lines 244 and 246 respectively. A second header card panel 204 is hinged to the top end straps 240 and 242 along fold lines 252 and 254 respectively and is also hinged to the platform panel 232 along a fold line 238. The second header card panel 204 has a pair of adhesive strips 210 and 212 disposed thereon. Side closure panels 272 and 274 are hinged to the top end straps 240 and 242 along fold lines 276 and 278. Side closure panels 256 and 258 are hinged to the front end straps 228 and 230 along fold lines 260 and 262, and additional side closure panels 264 and 266 are hinged to the bottom wall panel 220 along fold lines 268 and 270 respectively. Compound side closure panels denoted generally by the numerals 280 and 282 are hinged to the first header card panel 206 along fold lines 284 and 286 respectively. Each of the compound side closure panels 280 and 282 includes a glue tab 284 and 286 connected to an inner partition panel 288 and 290 along fold lines 292 and 294 respectively. The inner partition panels 288 and 290 are hinged to connecting panels 296 and 298 along fold lines 300 and 302 respectively, and the connecting panels 296 and 298 are hinged to outer partition panels 304 and 306 along fold lines 308 and 310. The glue tabs 284 and 286 are coated with adhesive 312 and 314.

Figure 8:
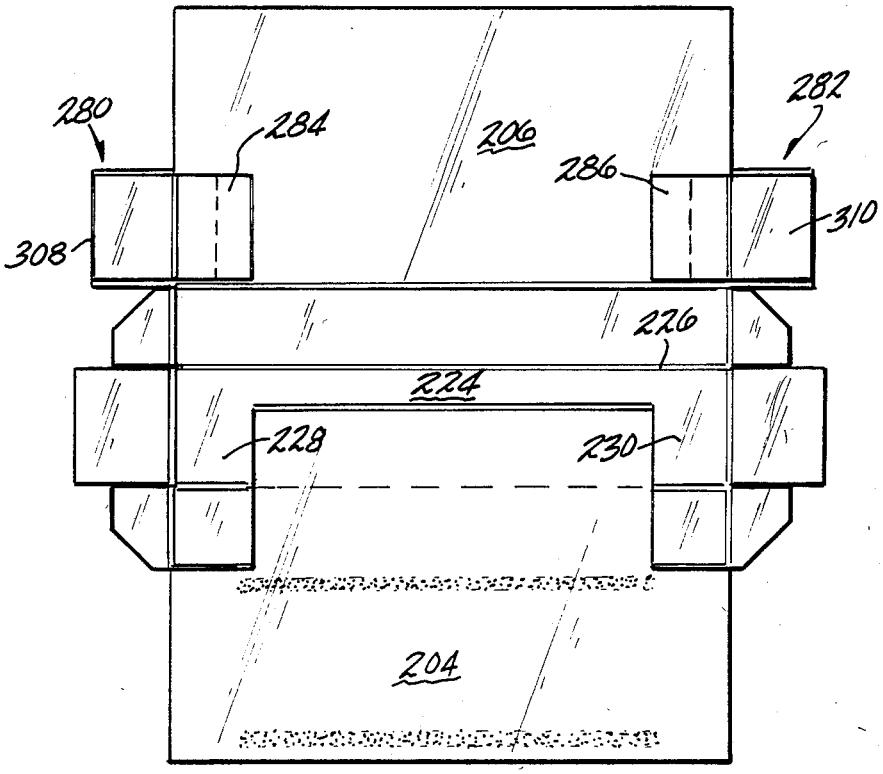
FIG. 8 is a plan view of the blank of FIG. 7 showing the first folding step for creating the flat bulk shipping configuration of the carton.

The first folding step for forming the flattened bulk shipping configuration of the carton is shown in FIG. 8 and involves folding the compound side closure panels 280 and 282 about the fold lines 308 and 310 to bring the glue tabs 284 and 286 into face-to-face contact with the first header card panel 206 whereby the tabs 284 and 286 are adhered to the panel 206. The second and final folding step for forming the flattened bulk shipping configuration of the carton is shown in FIG. 9 and involves folding the front wall panel 224, the front end straps 228 and 230, and the second header card panel 204 about the fold line 226 to bring the second header card panel 204 into face-to-face contact with the first header card panel 206 thereby securing the header card panels 204 and 206 together.

Figure 9:
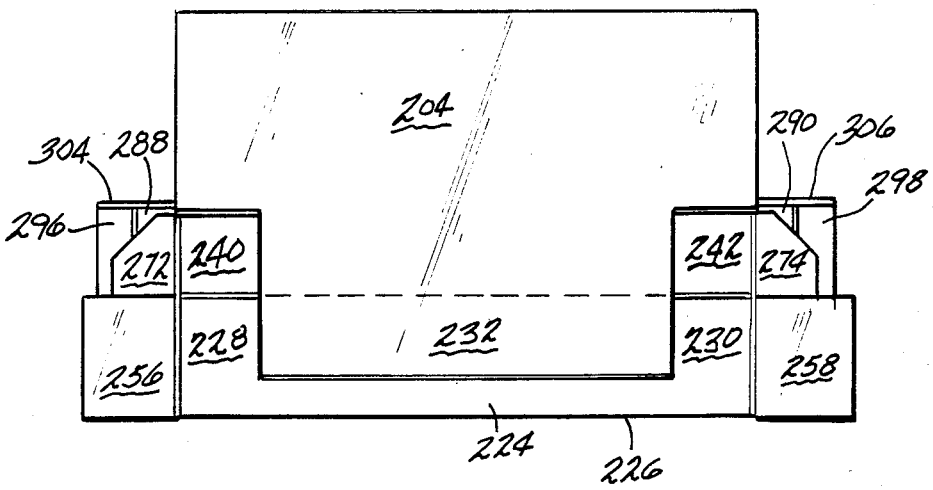
FIG. 9 is a plan view of the flattened bulk shipping configuration of the carton resulting from a second folding of the blank of FIG. 8.

Comparing FIGS. 4 and 9, it will be apparent that expansion of the flattened configuration shown in FIG. 9 will produce substantially the same carton as shown in FIG. 5 with inconsequential reverse orientation of the side closure panels.

It will be apparent that the carton of this invention will provide for substantial display of articles packaged therein while securely holding and protecting the packaged articles. Additionally, substantial area is provided by the header card for graphics display. The carton can be partially erected into a flat bulk shipping form by machine and can be easily expanded therefrom to its final operable form.

Since many changes and variations of the disclosed embodiments of the invention may be made without departing from the inventive concept, it is not intended to limit the invention otherwise than as required by the appended claims.

What is claimed is:

1. A display carton for displaying an article packaged therein, said carton comprising:

(a) a header card comprising a pair of header card panels disposed in face-to-face arrangement;

(b) a bottom wall hinged to one of said header card panels;

(c) a front wall hinged to said bottom wall; said front wall including a medial part of reduced height and opposite end strap parts of full height;

(d) a platform panel hinged to said front wall along an upper edge of said medial part of said front wall and said platform panel also being hinged to a header card panel;

(e) a pair of compound side closure panels on said carton, one of said compound side closure panels being interposed between each of said end strap parts of said front wall and the header card panel to which said bottom wall is hinged, each of said compound side closure panels including an outer partition panel, a connecting panel hinged to said outer partition panel, an inner partition panel hinged to said connecting panel, and a glue tab hinged to said connecting panel, and a glue tab hinged to said inner partition panel, said outer partition panels being hinged to opposite ends of one of said end strap parts of said front wall and said header card panel to which said bottom wall is hinged, said glue tabs being adhesively secured to the panel to which said outer partition panels are hinged, and said compound side closure panels being movabe between a flattened configuration wherein said outer partition panel, said connecting panel and said inner partition panel on each side closure panel are coplanar and parallel the the panel to which each side closure panel is hinged, and an expanded configuration wherein said inner and outer partition panels are spaced apart and parallel to each other and are perpendicular to the panel to which each side closure panel is hinged and wherein said inner partition panels are outwardly spaced from end edges of said platform panel.

2. The carton of claim 1, wherein said header card panels are hinged together along a top edge of the carton.

* * * * *